United States Patent [19]

Anthes et al.

[11] Patent Number: 4,532,033

[45] Date of Patent: Jul. 30, 1985

[54] METHOD FOR BENEFICIATING ORES

[75] Inventors: Robert J. Anthes, Plainsboro; Ross A. Kremer, Ringoes, both of N.J.

[73] Assignee: Mobil Oil Corporation, New York, N.Y.

[21] Appl. No.: 612,176

[22] Filed: May 21, 1984

[51] Int. Cl.[3] ..... B03D 1/14

[52] U.S. Cl. ..... 209/166

[58] Field of Search ..... 209/166

[56] References Cited

U.S. PATENT DOCUMENTS 3,113,838 12/1963 Perri et al. ..... 209/167
3,259,326 7/1966 Duke et al. ..... 209/166
4,324,653 4/1982 Henchiri et al. ..... 209/166
4,364,824 12/1982 Snow ..... 209/167
4,436,616 3/1984 Dufour et al. ..... 209/167

FOREIGN PATENT DOCUMENTS 735517 5/1966 Canada ..... 209/166

*Primary Examiner*—Bernard Nozick
*Attorney, Agent, or Firm*—Alexander J. McKillop; Michael G. Gilman; Charles J. Speciale

[57] ABSTRACT

In conventional froth floatation procedures for phosphate flotation, the feed is conditioned, diluted and floated. By lowering the pH with acid after the conditioning step, but before flotation, to a pH of from about 6.4 to about 7.0, one can improve phosphate selectivity.

5 Claims, No Drawings

METHOD FOR BENEFICIATING ORES

BACKGROUND OF THE INVENTION

1. Field of the Invention

The invention relates to an improved method for recovering phosphate rock from ores by froth flotation means. More particularly it relates to more efficiently beneficiating phosphate ores by reducing the pH of the feed slurry after conditioning and before flotation.

2. Summary of Prior Practices

Flotation is a step used in separating mineral values from their gangue or from another valuable component. Ores, such as phosphate ores, are generally separated by froth flotation, in which frothing is achieved by introducing air into finely divided ore and water containing a frothing agent. Those mineral strongly attracted to air bubbles rise to the surface in the froth, thereby allowing convenient separation. For froth flotation to work, the feed particles must be the correct size to be frothed away.

With respect to the preferred phosphate ore, apatite is the name applied to any of a group of calcium phosphate minerals containing other elements or radicals (as fluoride, chlorine, hydroxl, or carbonate), having the approximate general formula $Ca_5(F, Cl, OH, \frac{1}{2}CO_3)(PO_4)_3$, and occurring variously as hexagonal crystals, as granular masses, or in fine-grained often impure masses as the chief constituent of phosphate rock and of most or all bones and teeth. Exemplary apatites include fluoroapatite, carbonate apatite, chlorapatite and hydroxyl apatite.

The mineral occurs in the United States mainly in the form of the calcium phosphate ores that are referred to generically as phosphate rock. Phosphate rock is rock that consists of calcium phosphate largely in the form of apatite or carbonate apatite, usually together with calcium carbonate and other minerals, is useful in fertilizers and is a source of phosphorus compounds. It occurs in large beds in the southeastern U.S. and in extensive deposits in Arkansas and the northwestern U.S.

SUMMARY OF THE INVENTION

In accordance with the invention there is provided an improved method for beneficiating phosphate ores by froth flotation which comprises adding a mineral or organic acid to the conditioned feed, before flotation, to lower the pH at the start of flotation to about neutrality, that is from about 6.4 to about 7.0.

DISCUSSION OF SPECIFIC EMBODIMENTS

The present invention is applicable to phosphate ores. It will be understood that the invention is applicable to phosphate ores from all sources, including the preferred Florida phosphate, although the discussion which follows is based on phosphate ore typically found in Florida.

Typically, phosphate ore containing 15–35% BPL[bone phosphate of lime, $CA_3(PO_4)_2$] is concentrated in very large tonnages from deposits such as the Florida pebble phosphate deposits. The ore slurry from strip mining is sized at about 1 millimeter and the coarser fraction, after scrubbing to break up mud balls, is a finished product. The minus 1 mm fraction is further sized at 35 and 150 mesh. The minus 200 mesh slime is discarded. The 20×35 and 35×150 mesh fractions are conditioned with the same type of reagents and floated by conventional froth flotation routes. Not all the silica gangue is rejected by the fatty acid flotation so the concentrate is blunged with mineral acid to remove collector coatings, washed free of reagents and subjected to an amine flotation with kerosene at pH 7–8. This latter flotation, sometimes called "cleaning", removes additional silica and raises the final concentrate grade to 70–75% BPL. It is known, however, that the conventional system containing the fatty acid flotation agent has very poor selectivity for calcium phosphates in the presence of other minerals, since unsaturated fatty acids may be equally effective in separating calcium phosphate and the other minerals. There has, therefore, been a concerted effort to improve the selectivity of the phosphate values. For example, Swedish Pat. No. 326,417, issued Nov. 5, 1970 teaches avoidance of problem encountered in floating phosphate ore in the presence of calcite by floating the calcite at a low pH, after which the phosphate can be floated at an alkaline pH. U.S. Pat. No. 4,358,368, because of the two steps taught by the Swedish patent, and the economic infeasibility of the method, proposed to use an amphoteric surfactant for the same purpose.

We have found that by (1) conditioning the feed in the typical manner, specifically by raising the pH with a strong base such as ammonium hydroxide or an alkaline earth metal hydroxide such as sodium hydroxide, (2) conditioning this feed with a mixture of fatty acid and fuel oil collectors in the usual manner and then (3) lowering the pH to about neutrality with a mineral or organic acid, enhanced selectivity of the phosphate is achieved. It should be noted, as will be shown hereinafter, that the pH of the feed *must* be raised in a complete conditioning step and *then* lowered or otherwise one will get no phosphate upgrading at all.

The mineral or organic acid useful for lowering the pH of the conditioned feed may be sulfuric acid or acetic acid, but can also include other mineral acids such as hydrochloric and nitric acids or organic acids such as acetic and propionic acids.

As noted above, the pH of the conditioned feed is lowered by adding the acid to a value between about 6.4 and about 7.0 for flotation. The precise amount of acid in terms of weight or volume need not be stated because one skilled in the chemical arts will know immediately how to determine the concentrations of acid to use and how much of it is needed to give a desired pH.

It will be understood that the initially recovered phosphate valves may be further treated, as in the second or cleaner flotation step of a conventional two-step flotation process.

Having described the invention in general terms, the following are offered to illustrate it and as examples of comparative results.

EXAMPLE 1

A 1400 g sample of phosphate flotation feed (dry basis) was diluted to 70% solids with water. To this was added 10% $NH_4OH$ to give 0.5 lb. of ammonia per ton of feed and the mixture was stirred for 30 seconds, at the end of which the pH was 9.7. The equivalents of 0.7 lb of fatty acid (tall oil) and 1.4 of fuel oil per ton of feed were added and stirring was continued for 90 seconds. The pH was 9.6. The conditioned mixture was transferred to a Denver batch flotation cell and was diluted to 20% solids with water. The pH was reduced to 6.4 with sulfuric acid and aeration and agitation were begun. The feed was floated, after which the pH was 7.6, and the phosphate was recovered in the usual manner.

EXAMPLE 2

Example 1 was repeated, except that acid was not added, after the conditioning step, to lower the pH. In this example, which illustrates the conventional procedure for phosphate feed flotation, the pH just before and just after flotation was 9.0.

EXAMPLE 3

This example illustrates the results obtained when a reduced amount of 10% $NH_4OH$ was added, so that the flotation pH would be reduced without the addition of an acid such as sulfuric acid. Thus, enough 10% $NH_4OH$ was added to give a pH of 8.8 in the feed containing 70% solids. The pH after addition of fuel oil and fatty acid was 7.6, and was also 7.6 before and after flotation.

Results from flotations using feeds from Examples 1, 2 and 3 are shown in Table 1.

TABLE 1

| Example | Flotation pH, Begin | Flotation pH, Final | Phosphate Recovery % wt | Phosphate Grade - % BPL |
|---|---|---|---|---|
| 1 | 6.4 | 7.6 | 94.8 | 62.7 |
| 2 | 9.0 | 9.0 | 94.8 | 39.0 |
| 3 | 7.6 | 7.6 | 0 | 0 |

The results clearly illustrate the advantages gained by using the improvement provided by this invention, as exemplified in Example 1. Thus, by lowering the pH after conditioning one in the case presented gets the same percentage phosphate recovery, but the selectivity is dramatically improved to 62.7% BPL from to the 39% BPL obtained by conventional flotation methods.

Conclusions

The invention is to an improvement in selectivity in the rougher flotation step, but the improvement has the additional effect of giving a higher overall phosphate recovery in the conventional two-step rougher-cleaner flotation process. For example, the 62.7% BPL grade rougher concentrate achieved in Example 1 with the improvement of the invention is sufficiently high in phosphate to be fed to the cleaner flotation. Conversely the 39.0% BPL obtained in Example 2, which does not embody the invention, is not high enough in phosphate content to be acceptable as a cleaner flotation feed. The invention gives a net improvement, as as shown in the Examples, of 10–15% increase in phosphate recovery.

We claim:

1. A method for beneficiating phosphate ores by froth flotation, said method comprising the steps of:

(i) conditioning a phosphate ore feed by raising the pH with a strong base;

(ii) conditioning the phosphates ore feed resulting from step (i) by admixing therewith a mixture of a fatty acid and fuel oil; and (iii) reducing the pH of the conditioned phosphate ore feed resulting from step (ii), before rougher flotation, by the addition thereto of a sufficient amount of a mineral acid or organic acid to lower the pH to within a range of from about 6.4 to about 7.0 and recovering phosphates in the float of the rougher floatation.

2. The method of claim 1 wherein said acid is a mineral acid.

3. The method of claim 2 wherein said mineral acid is sulfuric acid.

4. The method of claim 1 wherein said acid is an organic acid.

5. The method of claim 4 wherein said organic acid is acetic acid or propionic acid.

* * * * *